US007108203B2

(12) United States Patent
Huffman et al.

(10) Patent No.: US 7,108,203 B2
(45) Date of Patent: Sep. 19, 2006

(54) INTERNAL MIX AIR ATOMIZING NOZZLE ASSEMBLY

(75) Inventors: David C. Huffman, Merrimack, NH (US); John E. Ekpenyong, Homewood, IL (US); John W. Bartell, Bartlett, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 11/210,238

(22) Filed: Aug. 23, 2005

(65) Prior Publication Data

US 2006/0038041 A1 Feb. 23, 2006

Related U.S. Application Data

(60) Provisional application No. 60/603,844, filed on Aug. 23, 2004.

(51) Int. Cl.
*B05B 7/06* (2006.01)
*A62C 2/08* (2006.01)

(52) U.S. Cl. ..... 239/427; 239/416.5; 239/417.3; 239/424; 239/432

(58) Field of Classification Search ..... 239/427, 239/416.5, 423, 424, 432, 417.3, 416.4, 548
See application file for complete search history.

(56) References Cited

U.S. PATENT DOCUMENTS 4,828,181 A * 5/1989 Singels-Craenen ..... 239/405
4,890,793 A * 1/1990 Fuglistaller et al. ..... 239/427
4,982,716 A * 1/1991 Takeda et al. ..... 123/531

* cited by examiner

*Primary Examiner*—Dinh Q. Nguyen
(74) *Attorney, Agent, or Firm*—Leydig, Voit & Mayer, Ltd

(57) ABSTRACT

An internal mix spray nozzle assembly adapted for operation with lesser pressurized air requirements. The spray nozzle assembly includes a liquid passage for directing a liquid flow stream against an impingement pin, and an air guide is provided for forming an annular pressurized air passage about the liquid flow stream for striking and atomizing a laterally spreading dispersion of liquid from the impingement surface. For enhancing liquid atomization, the air guide defines a relatively narrow width air flow opening for substantially accelerating and increasing the pressure of the atomizing air stream, and the impingement pin is formed with a relatively large primary impinging surface and a parallel downstream secondary impingement surface that facilitates further liquid particle breakdown and prevents the accumulation of liquids about the bottom of the impingement pin.

18 Claims, 1 Drawing Sheet

INTERNAL MIX AIR ATOMIZING NOZZLE ASSEMBLY

CROSS-REFERENCE TO RELATED PATENT APPLICATIONS

This application claims the priority of U.S. provisional application Ser. No. 60/603,844, filed Aug. 23, 2004.

FIELD OF THE INVENTION

The present invention relates generally to spray nozzles, and more particularly, to internal-mix, air-atomizing spray nozzles of the type in which a liquid flow stream is pre-atomized by pressurized air internally within the nozzle prior to discharge.

BACKGROUND OF THE INVENTION

Internal mix air atomizing nozzles are known in the art, such as shown in U.S. Pat. No. 5,732,885 assigned to the same assignee as the present invention, the disclosure of which is incorporated herein by reference. Such air atomizing nozzles are particularly effective for generating and discharging a finely atomized liquid spray at high flow rates.

Pressurized air sources available in customer plants sometimes are inadequate to enable such spray nozzles to be operated with optimum liquid atomization, particularly in spraying systems which involve a large number of such air atomizing nozzles. The need exists for air atomizing nozzles that can be optimally operated with lesser pressurized air requirements so as to (1) permit more economical use of smaller air compressors and (2) to enable greater numbers of air assisted spray nozzles to be operated from existing pressurized air sources. The need also exists for spray nozzles which are adapted to effect finer atomization of the liquid and which do not accumulate liquid within the nozzle body that can cause undesirable drippage from the nozzle, which detracts from the spray performance.

OBJECTS AND SUMMARY OF THE INVENTION

It is an object of the invention to provide an internal-mix spray nozzle assembly adapted for more efficiently generating air-atomized liquid spray discharges.

Another object is to provide a spray nozzle assembly as characterized above that can be operated for optimum spraying with lesser pressurized air requirements.

A further object is to provide a spray nozzle assembly of the above kind that is operable for discharging more finely atomized liquid spray patterns.

Still another object is to provide an internal mix air atomizing spray nozzle assembly of the foregoing type which is adapted for finely atomizing the liquid, while preventing the accumulation of liquid within the housing and resulting undesirable drippage from the nozzle during spray operations.

A yet further object is to provide a spray nozzle assembly of the above kind that is relatively simple in construction and economical to manufacture and operate.

Other objects and advantages of the invention will become apparent upon reading the following detailed description and upon reference to the drawings, in which:

Figure 1:
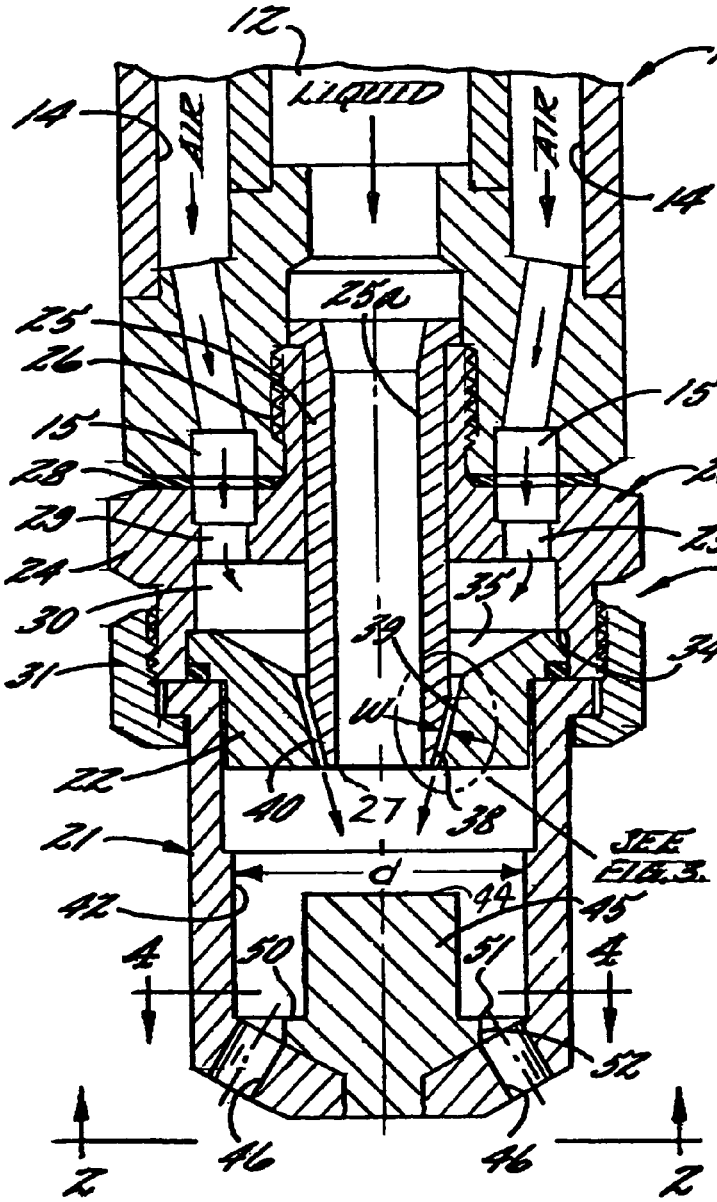
FIG. 1 is a longitudinal section of an illustrative air assisted spray nozzle assembly in accordance with the invention.
Figure 3:
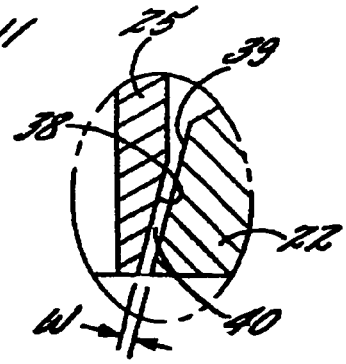
FIG. 3 is an enlarged fragmentary section of the encircled portion of the illustrated spray nozzle assembly indicated in FIG. 1.
Figure 4:
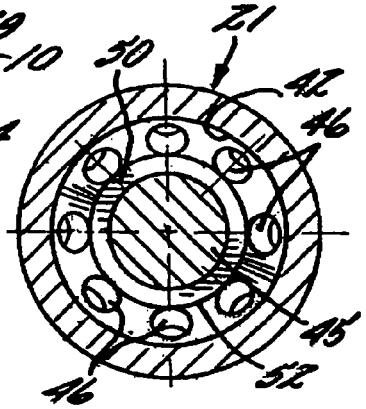
FIG. 4 is a transverse section of the spray nozzle assembly, taken in line of line 4—4 in FIG. 1.
Figure 2:
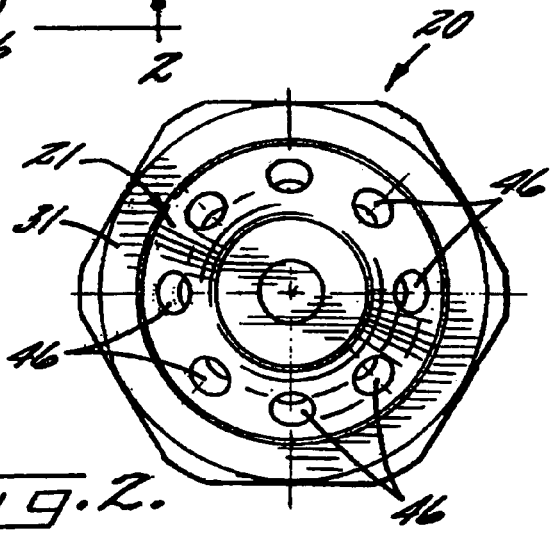
FIG. 2 is a downstream end view of the spray nozzle assembly shown in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE ILLUSTRATED EMBODIMENT

Referring now more particularly to the drawings, there is shown an illustrative internal-mix, air-atomizing spray nozzle assembly 10 in accordance with the invention connected to a conventional fluid supply manifold 11. The fluid supply manifold 11 in this case includes a central pressurized liquid supply passage 12 and a plurality of pressurized air supply passages 14 in surrounding relation to the liquid supply passage 12. The air passages 14 in this instance communicate with an annular manifold air passage 15 at a downstream end of the fluid supply manifold 11.

The illustrated spray nozzle assembly 10 basically comprises a nozzle body 20, a downstream spray tip 21, and an air guide 22 interposed between the nozzle body 20 and spray tip 21. The nozzle body 20 in this case is in the form of a multipart fluid supply subassembly comprising an outer annular body member 24 and an inner axial liquid supply tube 25 fixed therein which defines a liquid discharge orifice 27. The outer annular body member 24 has an externally threaded, upstream stem 26 secured within a threaded axial bore of the fluid supply manifold 11 with the liquid supply tube 25 in fluid communication with the liquid passage 12. An annular sealing gasket 28 in this case is interposed between the annular body member 24 and the downstream end of the fluid supply manifold 11. The annular body member 24 further is formed with a plurality of circumferentially spaced axial air passageways 29 that communicate between the annular manifold air passage 15 and an air chamber 30 about the liquid supply tube 25.

The spray tip 21 is secured to the nozzle body 20 by a threaded coupling nut 31 with the air guide 22 retained between an upstream end of the spray tip 21 and a counter bore 34 in the downstream end of the outer nozzle body member 24. A downstream end of the liquid supply tube 25 and a central bore 35 of the air guide 22 are formed with respective tapered surfaces 38, 39, which define an inwardly converging, annular air passageway 40. The annular air passageway 40 directs pressurized air from the annular air chamber 30 into an expansion chamber 42 within the spray tip 21 simultaneously as liquid is directed through and discharges from a downstream discharge orifice 27 of the liquid supply tube 25. The discharging liquid impacts with a primary transverse impingement surface 44 of an upstanding impingement pin or pintel 45 of the spray tip 21, which facilitates both mechanical and air atomized liquid particle breakdown of the liquid as it is dispersed laterally of the impingement surface 44. The lateral liquid dispersion is further broken down and atomized by the annular air flow stream prior to discharge from the spray tip 21 through a plurality of circumferentially spaced discharge orifices 46 disposed in surrounding relation to the impingement pin 45, which effect further liquid particle breakdown and atomizations.

In accordance with the invention, the air guide is designed to more efficiently atomize and break down liquid into finer liquid particles with lesser pressurized air requirements. To this end, the annular air passageway 40 defined between the air guide 22 and liquid supply tube 25 has a relatively narrow width w for accelerating and substantially increasing the pressure of air stream directed into the spray tip for enhanced atomization of liquid impinging the impingement surface 44. The ratio of the flow area of the annular air passageway 40 and the area of the liquid discharge orifice 27 of the liquid supply passageway 25*a* preferably is between 1:2 and 1:3, and most preferably, about 1:2.5. The ratio of the flow area of the annular air passageway 40 and the transverse area of the spray tip expansion chamber 42, as defined by the diameter "d" of the expansion chamber 42, preferably is between 1:27 and 1:33, and most preferably, about 1:30. In the illustrated embodiment, the area of the air passageway 40 between the air guide 22 and liquid supply tube 25 is 0.06 square inches, the area of the liquid supply passage 25*a* and the discharge orifice 27 thereof is 0.15 square inches, and the area of the expansion chamber 42 is 1.83 square inches. The resulting increase in pressure and velocity of the air stream discharging from the annular air passageway 40 more aggressively engages and interacts with the liquid impinging transversely from the impingement surface 44 for more effective atomization.

In carrying out the invention, the impingement pin 45 has a relatively large impingement surface 44 that causes the liquid striking the impingement surface to proceed transversely outwardly in a relatively thin sheet as it approaches the peripheral edge of the impingement pin for enhanced interaction and atomization by the high pressurized air stream. The ratio of the area of the impingement surface 44 to the area of the expansion chamber 42 preferably is between about 1:3.8 to 1:4.4, and most preferably, about 1:4. It will be appreciated that the expansion chamber 42 is sufficiently large to prevent the atomized liquid particles generated therein to commingle together and reform into larger particles prior to discharge from the spray nozzle.

In carrying out this aspect of the invention, in order to provide sufficient volume within the spray tip for expansion of the liquid particles upon atomization, the air guide 22 does not extend substantially beyond the downstream end of the liquid supply tube 25. In the illustrated embodiment, the downstream end of the air guide 22 is substantially co-planar with the downstream end of the liquid supply tube 25.

In keeping with a further feature of the invention, the spray tip 21 is formed with a secondary impingement surface 50 downstream of and parallel to the primary impingement surface 44 for further breaking down the liquid particles prior to direction through the spray tip discharge orifices 46. In the illustrated embodiment, the impingement pin 45 is defined by a separate pintel concentrically mounted within the spray tip which defines both the upper primary impingement surface 44 and the downstream or secondary annular impingement surface 50. The downstream annular impingement surface 50 in this case is in the form of a small radial ledge with an outer peripheral sharp corner 51 which further shears the liquid particles as they are directed toward the spray tip discharge orifices 46.

In carrying out still a further feature of the invention, the ledge that defines the secondary impingement surface occupies the bottom most portion of the spray tip expansion chamber 42 so as to prevent the formation of a trough in the bottom of the spray tip that could accumulate liquid and cause drippage of liquid from the nozzle during spray operations. In this instance, the outer radial edge 51 of the secondary impingement surface 50 is defined by a cylindrical surface 52 in alignment with the inner radial edges of the spray tip discharge orifices 46 so that no trough or other liquid accumulating crevice can exist. Liquid particles atomized within and directed through the expansion chamber 42 of the spray tip 21 are forced to continue their movement to and through the discharge orifices 46, without agglomeration and accumulation within any liquid containing crevices of the spray tip.

From the foregoing, it can be seen that the spray nozzle assembly of the present invention is adapted for more efficiently generating and directing finely atomized discharging sprays. The subject spray nozzle assembly can be operated with smaller pressurized air generating equipment, while effecting a high-volume of more finely atomized, discharging liquid spray.

The invention claimed is:

1. A spray nozzle assembly comprising a nozzle body with a liquid flow passageway having a liquid discharge orifice for directing a high velocity liquid flow stream along a predetermined axis, a spray tip fixed to said body having an upstanding impingement pin that defines a primary impingement surface spaced from said liquid discharge orifice and dispose transverse to said axis whereby a liquid stream directed onto said impingement surface strikes said impingement surface and breaks up into a laterally spreading dispersion of liquid from said impingement surface, an air supply for directing pressurized air through said body, an air guide disposed about said axis upstream of said impingement surface and formed with an internal surface defining an annular air flow passage for enhancing the velocity of the pressurized air and directing the air in a curtain about the liquid flow stream for striking the laterally spreading dispersion of liquid to further break up and atomize liquid into liquid particles, said annular air passage having a flow passage area greater than the area of said liquid discharge orifice with the ratio of the area of the annular air passage to the area of the liquid discharge orifice being between 1:2 and 1:3, said spray tip defining an expansion chamber about and downstream of said impingement surface for preventing atomized liquid particles from commingling together and reforming into larger particles, and said spray tip having a plurality of discharge orifices spaced downstream from said impingement surface and communicating with said expansion chamber through which said atomized liquid particles are discharged from said chamber while being further atomized.

2. The spray nozzle assembly of claim 1 in which of said expansion chamber has a transverse area substantially greater than the flow passage area of said annular air passage with the ratio between the area of the annular air flow passage and the transverse area of the spray tip expansion chamber being between 1:27 and 1:33.

3. The spray nozzle assembly of claim 2 in which the transverse area of said expansion chamber is substantially greater than the area of said impingement surface with the ratio of the area of the impingement surface to the transverse area of that expansion chamber being between 1:3.8 and 1:4.4.

4. The spray nozzle assembly of claim 1 in which said nozzle body includes a liquid supply tube which defines said liquid flow passageway and liquid discharge orifice, and said annular air flow passage is defined by an annular space between said air guide internal surface and said liquid supply tube.

5. The spray nozzle assembly of claim 4 in which said air guide internal surface and liquid supply tube decrease in cross section in a downstream direction for defining an inwardly converging, annular air passage.

6. The spray nozzle assembly of claim 4 in which said air guide has a downstream end substantially coplanar with a downstream end of said liquid supply tube.

7. The spray nozzle assembly of claim 1 in which said spray tip has a secondary infringement surface parallel to and downstream from said primary impingement surface for further breaking down and atomizing the liquid particles prior to direction through said spray tip discharge orifices.

8. The spray nozzle assembly of claim 7 in which said secondary impingement surface is defined by a ledge extending radially outwardly from said impingement pin downstream from said primary impingement surface.

9. A spray nozzle assembly comprising a nozzle body with a liquid flow passageway having a liquid discharge orifice for directing a high velocity liquid flow stream along a predetermined axis, a spray tip fixed to said body having an upstanding impingement pin that defines a primary impingement surface spaced from said liquid discharge orifice and dispose transverse to said axis whereby a liquid stream directed onto said impingement surface strikes said impingement surface and breaks up into a laterally spreading dispersion of liquid from said impingement surface, an air supply for directing pressurized air through said body, an air guide disposed about said axis upstream of said impingement surface and formed with an internal surface defining an annular air flow passage for enhancing the velocity of the pressurized air and directing the air in a curtain about the liquid flow stream for striking the laterally spreading dispersion of liquid to further break up and atomize liquid into liquid particles, said spray tip defining an expansion chamber about and downstream of said impingement surface for preventing atomized liquid particles from commingling together and reforming into larger particles, said annular air passage having a flow passage area substantially less than a transverse area of said expansion chamber with the ratio between the area of said annular air flow passage and the transverse area of the spray tip expansion chamber being between 1:27 and 1:33, and said spray tip having a plurality of discharge orifices spaced downstream from said impingement surface and communicating with said expansion chamber through which said atomized liquid particles are discharged from said expansion chamber while being further atomized.

10. The spray nozzle assembly of claim 9 in which the transverse area of said expansion chamber is substantially greater than the area of said impingement surface with the ratio of the area of the impingement surface to the transverse area of that expansion chamber being between 1:3.8 and 1:4.4.

11. The spray nozzle assembly of claim 10 in which said spray tip has a secondary infringement surface parallel to and downstream from said primary impingement surface for further breaking down and atomizing the liquid particles prior to direction through said spray tip discharge orifices.

12. A spray nozzle assembly comprising a nozzle body with a liquid flow passageway having a liquid discharge orifice for directing a high velocity liquid flow stream along a predetermined axis, a spray tip fixed to said body having an upstanding impingement pin that defines a primary impingement surface spaced from said liquid discharge orifice and dispose transverse to said axis whereby a liquid stream directed onto said impingement surface strikes said impingement surface and breaks up into a laterally spreading dispersion of liquid from said impingement surface, an air supply for directing pressurized air through said body, an air guide disposed about said axis upstream of said primary impingement surface and formed with an internal surface defining an annular air flow passage for enhancing the velocity of the pressurized air and directing the air in a curtain about the liquid flow stream for striking the laterally spreading dispersion of liquid to further break up and atomize liquid into liquid particles, said impingement pin having a secondary impingement surface parallel to and downstream from said primary impingement surface for further breaking down and atomizing the liquid particles prior to direction through said spray tip discharge orifice, said spray tip defining an expansion chamber about said primary impingement surface for preventing atomized liquid particles from commingling together and reforming into larger particles, and said spray tip having a plurality of discharge orifices spaced downstream from said primary impingement surface through which said atomized liquid particles are discharged from said chamber while being further atomized.

13. The spray nozzle assembly of claim 12 in which said secondary impingement surface is defined by a ledge extending radially outwardly from said impingement pin downstream from said primary impingement surface.

14. The spray nozzle assembly of claim 13 in which said secondary impingement surface defining ledge has a sharp outer edge.

15. The spray nozzle assembly of claim 12 in which said secondary impingement surface is an annular surface extending outwardly about said impingement pin.

16. The spray nozzle assembly of claim 12 in which said primary and secondary impingement surfaces are defined by a separate insert member mounted within said spray tip.

17. The spray nozzle assembly of claim 13 in which said secondary impingement surface defining ledge has an outer perimeter adjacent inner radial edges of said circumferentially spaced spray tip discharge orifices for preventing the accumulation of liquid about a downstream end of said impingement pin.

18. The spray nozzle assembly of claim 1 in which said liquid flow passageway discharge orifice is defined by a liquid supply tube having an external frustoconical downstream end, and said air guide internal surface has a frustoconical shaped complimentary to and surrounding in spaced relation said frustoconical liquid supply tube downstream end for defining an inwardly converging uniform width air flow passageway there between for directing the annular curtain of air.

* * * * *